US005779000A

United States Patent [19]

Lin

[11] Patent Number: 5,779,000

[45] Date of Patent: Jul. 14, 1998

[54] EMERGENCY ESCAPE DEVICE

[76] Inventor: Rong-Dar Lin, P.O. Box 2103, Hsin Chu hsien, Taichung, Taiwan

[21] Appl. No.: 499,760

[22] Filed: Jul. 10, 1995

[51] Int. Cl.[6] ..... E06C 9/00

[52] U.S. Cl. ..... 182/95; 182/70

[58] Field of Search ..... 182/95, 70, 196, 182/197, 198

[56] References Cited

U.S. PATENT DOCUMENTS

| | | | |
|---|---|---|---|
| 280,527 | 7/1883 | Smiley | 182/70 |
| 3,055,452 | 9/1962 | Bourdunis | 182/95 |
| 3,263,773 | 8/1966 | Sallein | 182/95 |
| 4,401,183 | 8/1983 | Schler | 182/95 |
| 5,022,491 | 6/1991 | Gill | 182/95 |

*Primary Examiner*—Alvin C. Chin-Shue
*Assistant Examiner*—Anita M. King

[57] ABSTRACT

This is an emergency escape device for prevention of burglary and for escaping from a window on a building wall. Because this emergency escape device provides the design of guiding portions on a plurality of fixed seat assemblies and movable seat assemblies, it reduces the vibration and noise problems caused by strong wind. Also, when in use under emergency conditions, the escape ladder assembly can be extended down from a window. Because of this emergency escape device provide special designs on these fixed seat assemblies and movable seat assemblies, they can afford more impact forces when the escape ladder assembly is extending. This prolongs the safety and life of the device.

7 Claims, 7 Drawing Sheets

EMERGENCY ESCAPE DEVICE

BACKGROUND OF THE INVENTION

This invention relates to an emergency escape device, more particularly to a device having an extendable escape ladder assembly for prevention of burglary and for escaping from a window on a building wall with better safety and longer product's life.

In order to have more safety, some families install burglary-proof grilles or the like on their windows for prevention of burglary. Some of this kind of windows with grilles have emergency openings for escaping under emergency conditions. Usually, these emergency openings are locked for preventing burglary. However, although there are emergency openings, when it is under emergency conditions, most people need to use other auxiliary equipments to escape away; otherwise, they have to jump out from the window. This will make people hurt so that the emergency opening is useless.

SUMMARY OF THE INVENTION

The primary objective of this invention is to provide an emergency escape device with an extendable escape ladder assembly for prevention of burglary and for escaping from a window on a building wall with better safety and longer product's life.

DETAILED DESCRIPTION OF THE INVENTION

Figure 1:
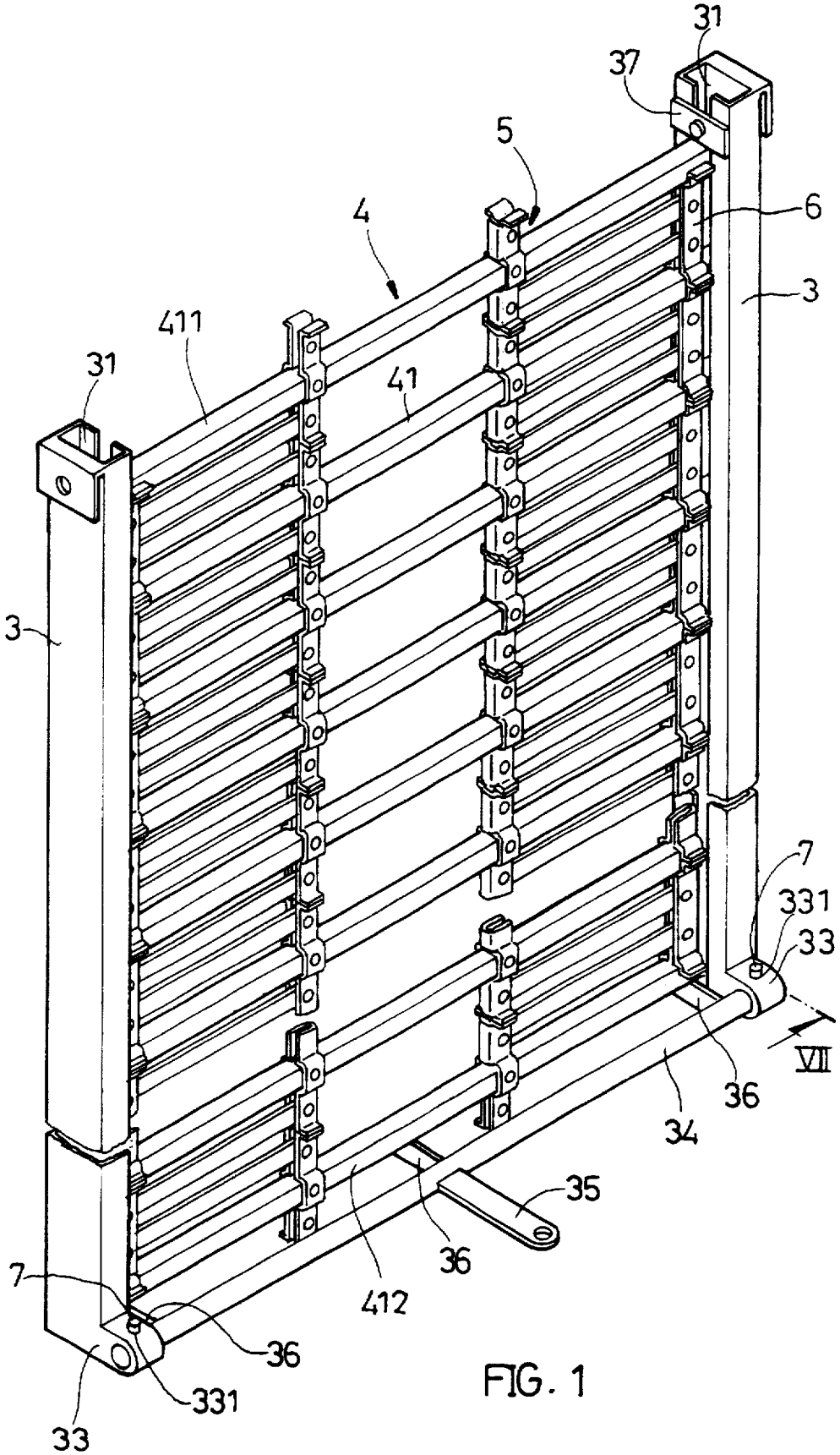
FIG. 1 is a perspective view of the preferred embodiment of the present invention.

Please refer to FIGS. 1 to 7. The present invention is an emergency escape device for prevention of burglary and for escaping from a window 8 on a building wall, said window 8 having a top edge and a bottom edge.

The emergency escape device comprising a upper connecting structure 1, a lower connecting structure 2, a pair of parallel sliding groove assembly 3, an escape ladder assembly 4, a plurality of fixed seat assemblies 5, a plurality of movable seat assemblies 6, and two pins 7.

Figure 2:
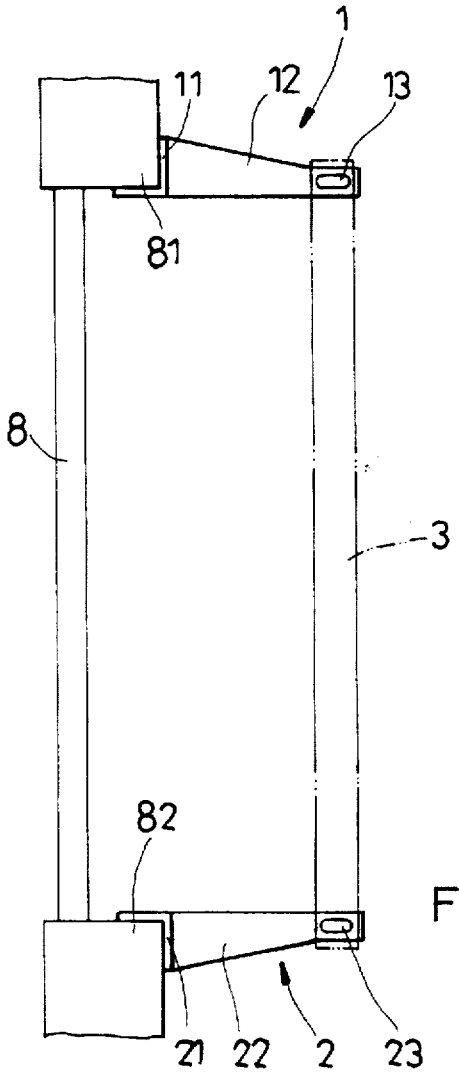
FIG. 2 is a side view of the present invention.
Figure 3:
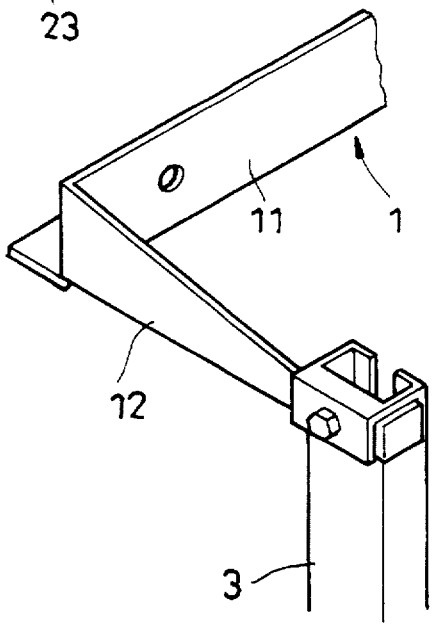
FIG. 3 is a fragmentary view of the present invention showing the connection of the upper connection structure and the sliding groove assembly.

Referring to FIGS. 2 and 3, the upper connecting structure 1 is fixed on a wall near said window's top edge 81 and a lower connecting structure 2 is fixed on said wall near said window's bottom edge 82. The upper and lower connecting structures 1, 2 have L-shaped connecting plates 11, 21 fixed on the edges 81, 82; connecting plates 12, 22 extending from said L-shapes plates 11, 21; and holes 13, 23 on the ends of said L-shaped plates 11, 21 correspondingly.

Referring to FIGS. 1 to 7 again, the pair of parallel sliding groove assemblies 3 are fixed between said upper connecting structure 1 and said lower connecting structure 2 by fasteners through said holes 13, 23. Said pair of sliding groove assemblies 3 have two vertical longitudinal sliding grooves 31, two stopping parts 32, and two pin seats 33. In which, each of the longitudinal sliding grooves 31 extends from the sliding groove's 3 top to its bottom. The grooves of the sliding grooves 31 are facing each other and the sliding grooves 31 have inner longitudinal groove surfaces. The stopping part 32 are disposed at the bottom end. The pin seats 33 are located at the bottom end and have two pin holes 331. A rotatable controlling rod 34 having a handle 35 and three supporting parts 36 extending from said rod 34. Said controlling rod 34 is pivoted on the pin seats 33. The pins seat 33 further have corresponding through holes 341 so that these two pins 7 can be inserted into the holes 331 and through holes 341.

The escaping ladder assembly 4 includes a plurality of horizontal rods 41 and a plurality of side rod assemblies 42. The top horizontal rod 411 has two ends which connect with two sliding plates 37. Regarding the plurality of side rod assemblies 42, especially referring to FIG. 4, each of said side rod assembly 42 has two linking rods 43 pivotally connected together. Also, the length of each horizontal rod 41 is slightly less than the distance between the inner groove surfaces of said pair of sliding grooves 31 so that said horizontal rods 41 can slide upward or downward freely. The length of each linking rod 43 is approximately ¼ of said horizontal rod's 41 length.

With regard to the plurality of fixed seat assemblies 5, each of said fixed seat assembly is disposed on a predetermined position near the ¼ of said horizontal rod's length from a end. Also, each of said fixed seat assembly 5 has: two parallel first plates portions; a upper connecting plates 51 for connecting said parallel plate portions; a lower connecting plates 52 for connecting said parallel plate portions; a central opening 53 between said upper connecting plate 51 and said lower connecting plate 52 for inserting one horizontal rod 41; two first pivoting holes 54 for pivotally connecting two adjacent linking rods 43; a first top guiding portion 55; a first bottom guiding portion 56; and a screw hole 57 for securing the fixed seat assembly on the horizontal rod 41.

Regarding the plurality of movable seat assemblies 6, each of said movable seat assembly 6 has: two parallel second plate portions, a central connecting plate 61 for connecting said parallel plate portions, a top recess 62 for clasping a horizontal rod 41, a bottom recess 63 for clasping another horizontal rod 41, two second pivoting holes 64 for pivotally connecting two adjacent linking rods 43, a second top guiding portion 65, and a second bottom guiding portion 66.

Therefore, one end of each linking rod 43 pivotally connecting with a first pivoting hole 54 of a fixed seat assembly 5 and the other end of said linking rod 43 pivotally connecting with a second pivoting hole 64 of a movable seat assembly 6 so as to make the escape ladder assembly 4 can be extended down and become a ladder-like structure under emergency conditions.

When the device is not in use, the linking rods 43 are disposed as parallel as shown in FIG. 1. The top recess 62 and the bottom recess 63 of the movable seat assemblies 6 are to clasp the horizontal rods 41. The first top guiding portions 55 of one fixed seat assembly 5 are neighbored the bottom guiding portions 56 of the adjacent fixed seat assemblies 5. These horizontal rods 41 can be slidden into the sliding grooves 31. The bottom horizontal rod 412 is supporting by the supporting parts 36 which are extended horizontally from the controlling rod 34. There is a handle 35 on the controlling rod 34. Two pins 7 can be inserted into the pin holes 331 of the pin seats 33 and into the through holes 341 of the controlling rod 34 so as to provide a grille-like structure for prevention of burglary.

Figure 4:
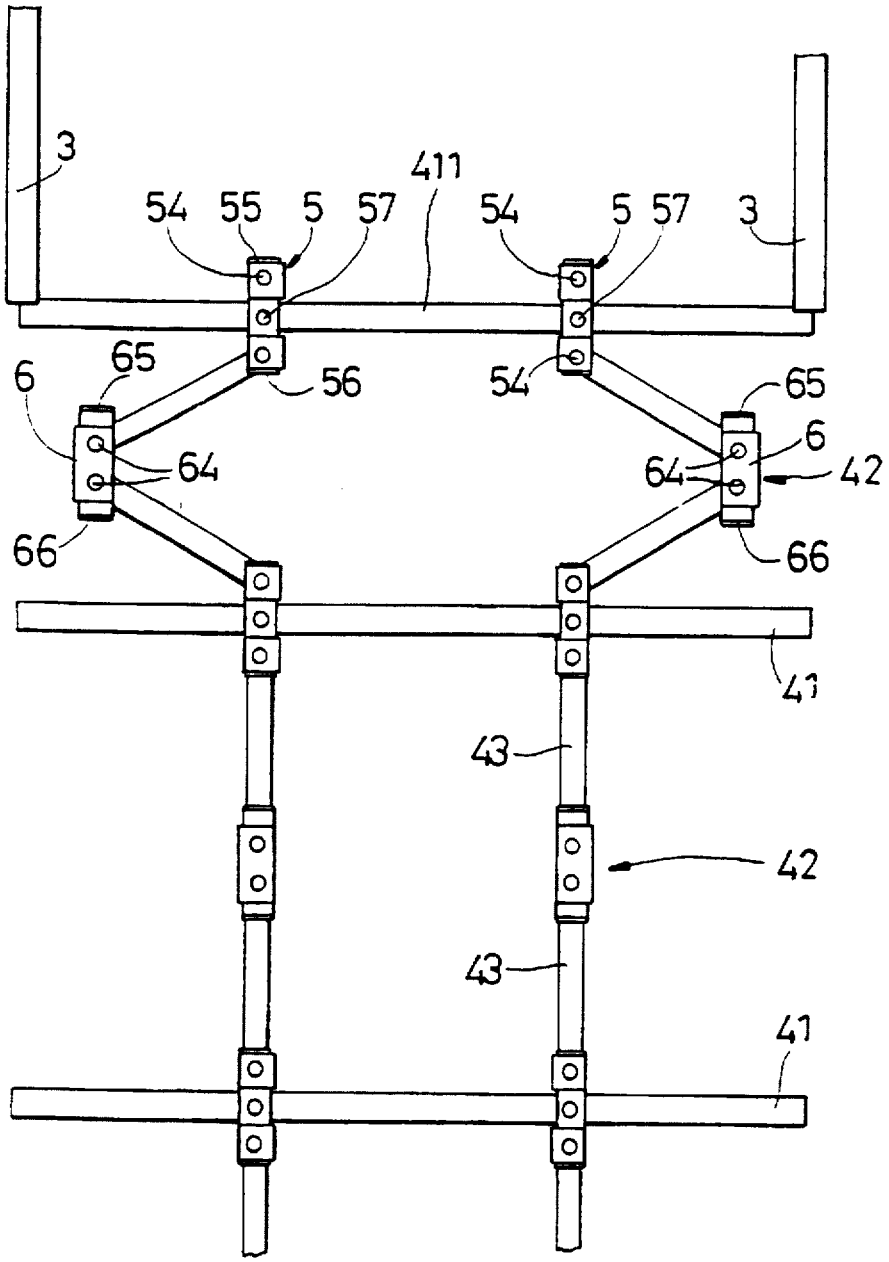
FIG. 4 is a front view of the present invention when the escape ladder assembly is extended.
Figure 5:
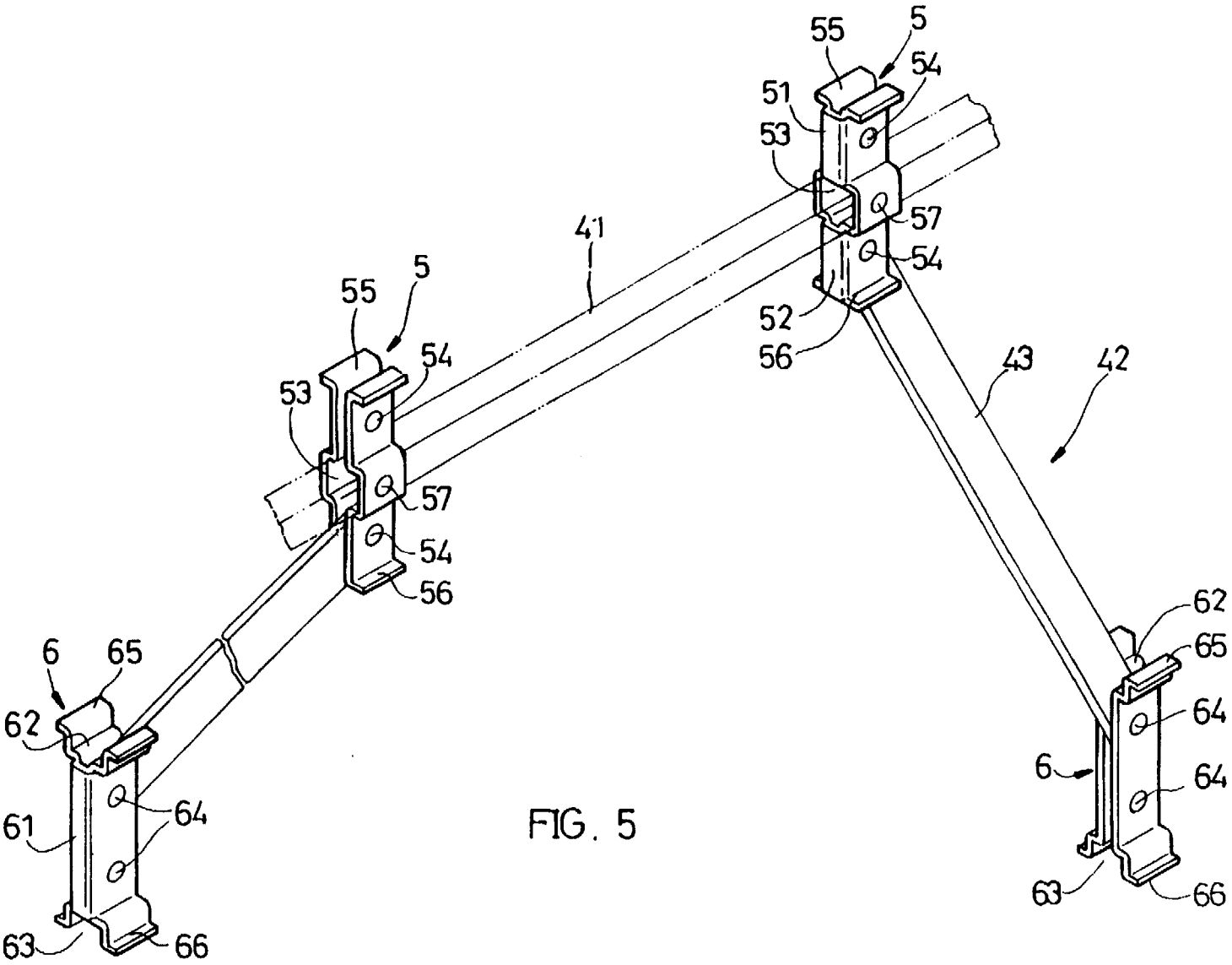
FIG. 5 is a perspective view of the present invention showing the structure of the escape ladder assembly.
Figure 6:
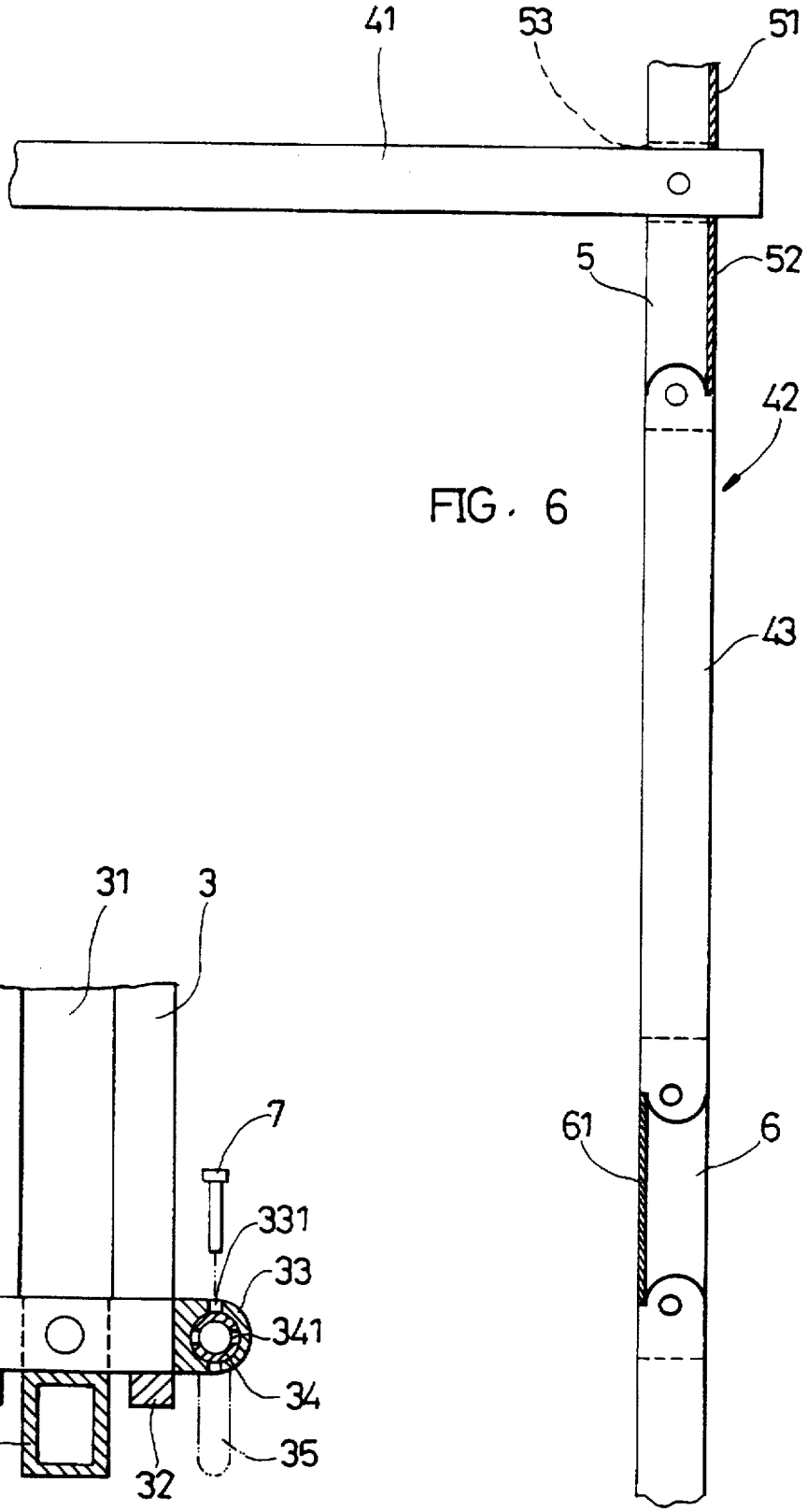
FIG. 6 is a side view showing the structure of the escape ladder assembly.
Figure 7:
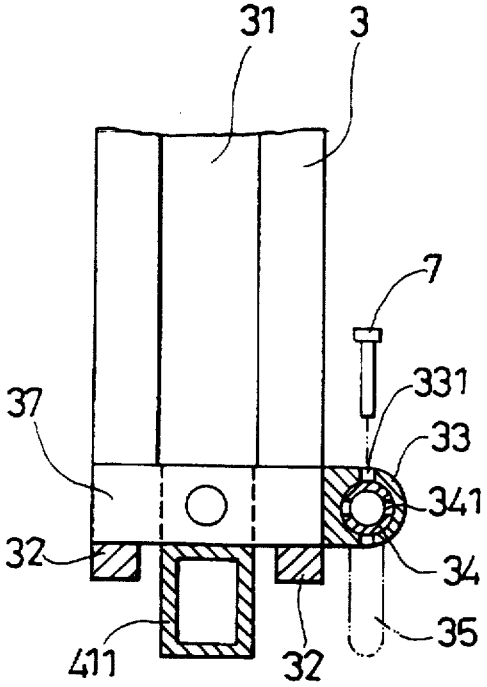
FIG. 7 is a cross-sectional view taken along the line VII—VII in FIG. 1.

When in use, under emergency conditions, just pick up the pins 7 first. Then, rotate the handle 35 of the controlling rod 34 upward so that the supporting parts 36 rotates downward accordingly. Consequently, the horizontal rods 41 and side rod assemblies 42 will fall down and makes the escape ladder assembly 4 be extended downward, as illustrated in FIG. 4. Finally, the sliding plates 37 of the top horizontal rod 411 will stop at the stopping parts 32 near the ends of the sliding grooves 31. After this escape ladder assembly 4 are completely extended, people can climb down from the window.

Due to the gravity, the escape ladder assembly 4 is extended very quickly, almost just only several seconds. Thus, under emergency conditions, people can escape from a window by using the present invention.

The present invention has the following improvements.

(1) The horizontal rods 41 can be inserted into the central opening 53 of the fixed seat assemblies 5 and secured by a screw. And every fixed seat assembly 5 has a symmetric first top guiding plates 55 and first bottom guiding plates 56. Thus, there are a lot of spaces in the middle of the device among these horizontal rods 41 for allowing wind blowing through.

(2) The purpose of the top recess 62 and the bottom recess 63 are to clasp the adjacent two horizontal rods 41 firmly. Also, the second top guiding portions 65 and the second bottom guiding portions 66 are to touch each other. This minimizes the vibration due to strong wind. Further, this reduce the noise substantially.

(3) Due to the structures of upper connection plates 51, 52 and the central connecting plates 61, it enhances the ability to afford impact forces while extending. That is, while the escape ladder assembly 4 is extending down, the fixed seat assemblies 5 and the movable seat assemblies 6 can afford more impact forces. This will prolong the safety and life of the device.

Figure 8:
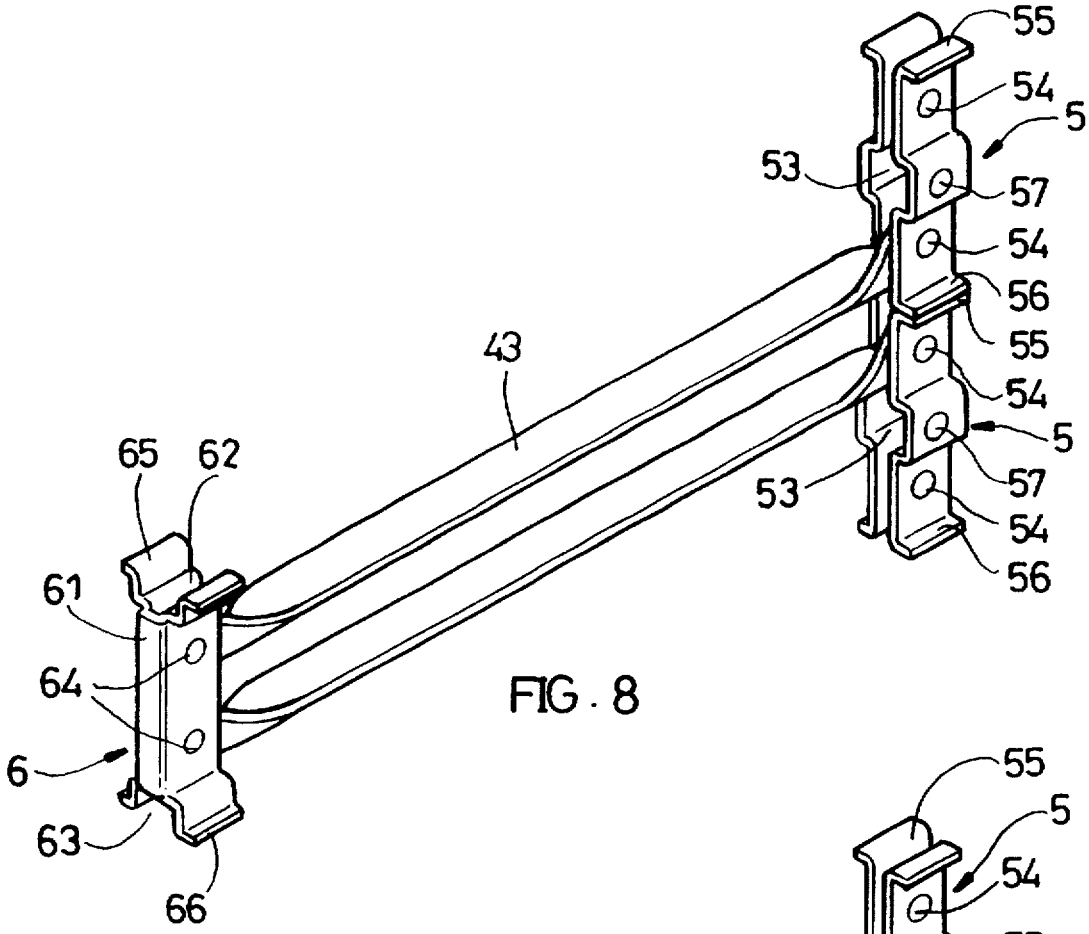
FIG. 8 illustrates the first possible modification of the side rod assemblies.
Figure 9:
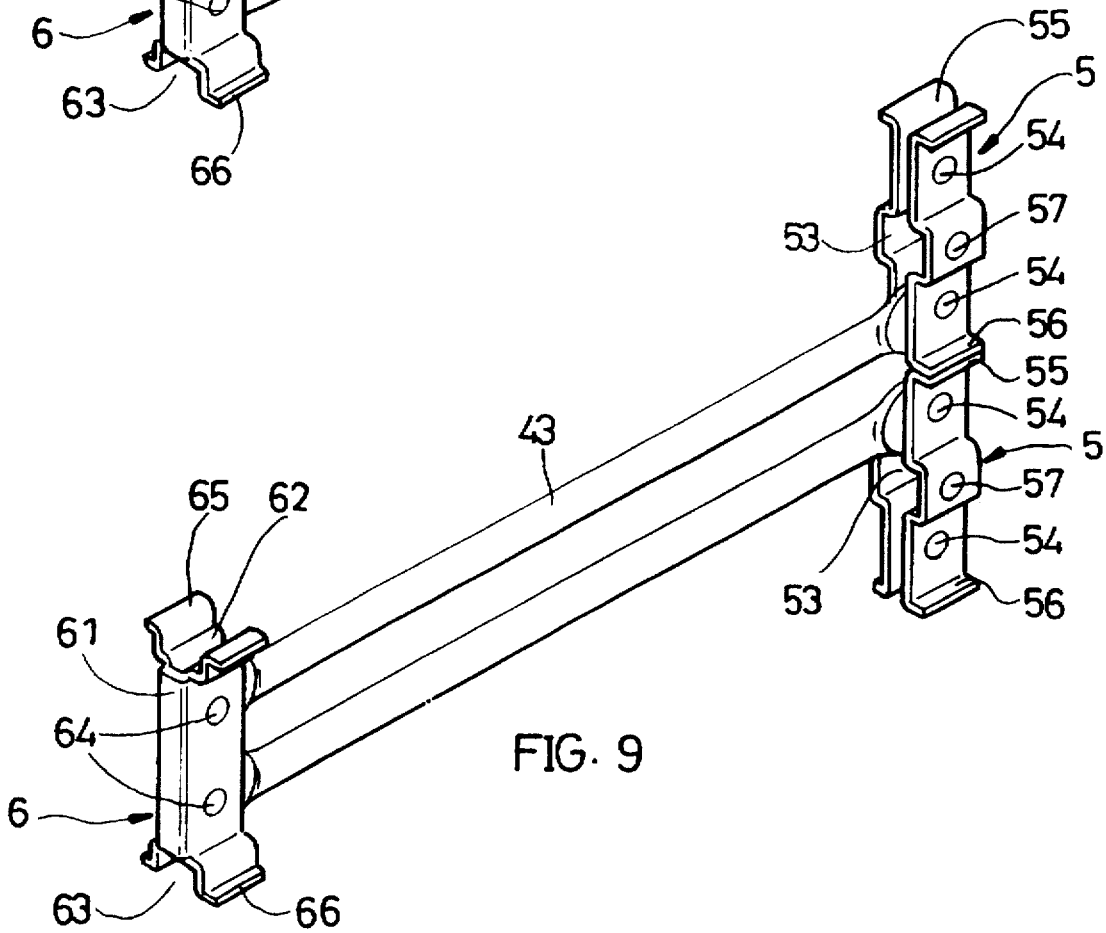
FIG. 9 illustrates the second possible modification of the side rod assemblies.

The present invention can be modified in structure, material and so on. For examples, the emergency escape device can be made of stainless steel or other materials. With the regard to the structure of the linking rod, it can be modified as a twisted rod as shown in FIG. 8 or it can be modified as a rod as shown in FIG. 9.

Figure 10:
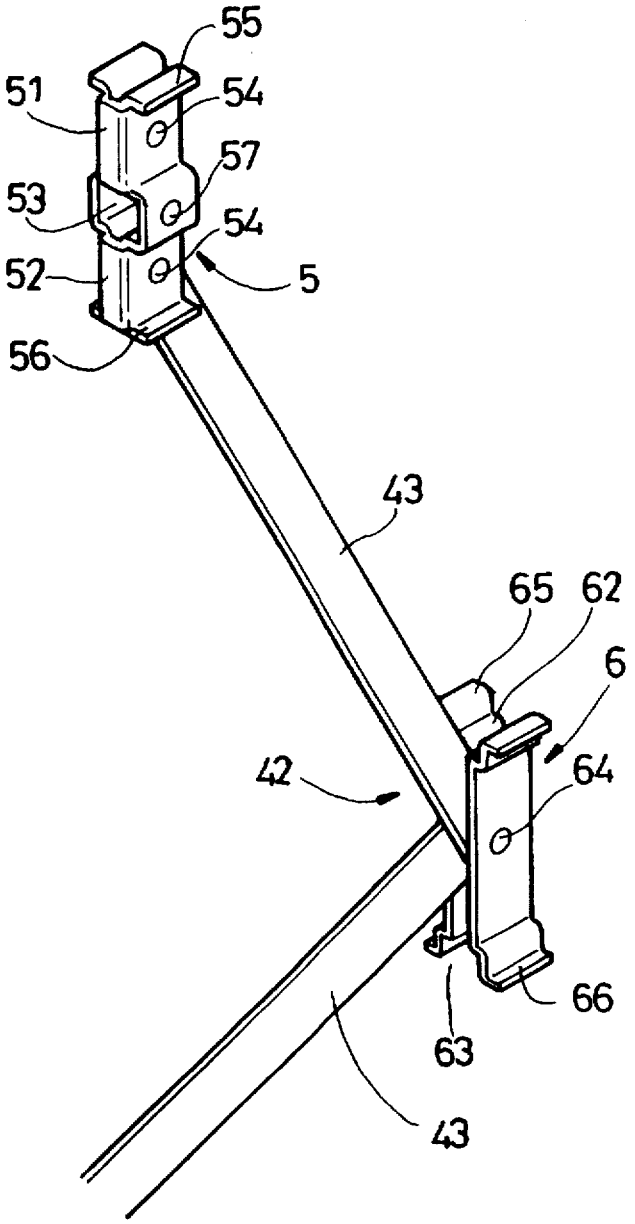
FIG. 10 shows another possible structure of the side rod assembly.

Of cause, the second pivoting holes 64 of the movable seat assembly 6 can be modified into one single pivoting hole 64 for pivotally connecting two linking rods at one hole as shown in FIG. 10. While the present invention has been described in terms of preferred and other embodiments, it is understood that any minor variations and modifications are still within the scope of the invention as claimed.

I claim:

1. An emergency escape device for prevention of burglary and for escaping from a window on a building wall, said window having a top edge and a bottom edge, said emergency escape device comprising:

an upper connection structure for fixing on a wall near said window's top edge and a lower connecting structure for fixing on said wall near said window's bottom edge;

a pair of parallel sliding groove assemblies being fixed between said upper connecting structure and said lower connecting structure, each of said sliding groove assembly having a longitudinal sliding groove extending from the sliding groove's top to its bottom vertically, said sliding groove having an inner longitudinal groove surface, and a stopping part at the bottom end, wherein said sliding grooves face each other;

an escaping ladder assembly including a plurality of horizontal rods, the top horizontal rod having to two ends which connect two sliding plates, and a plurality of side rod assemblies, each of said side rod assembly having two linking rods pivotally connected together, wherein the length of each horizontal rod is slightly less than the distance between the inner groove surfaces of said pair of sliding grooves, and the length of each linking rod being approximately ¼ of said horizontal rod's length;

a plurality of fixed seat assemblies, each of said fixed seat assembly fixed on a pre-determined position near ¼ of said horizontal rod's length, each of said fixed seat assembly having two parallel first plates portions, an upper connecting plate for connecting said parallel plate portions, a lower connecting plate for connecting said parallel plate portions, a central opening between said upper connecting plate and said lower connecting plate for inserting one horizontal rod, and two first pivoting holes for pivotally connecting two adjacent linking rods;

a plurality of movable seat assemblies, each of said movable seat assembly having two parallel second plate portions, a central connecting plate for connecting said parallel plate portions, a top recess for clasping a horizontal rod, a bottom recess for clasping another horizontal rod, and two second pivoting holes for pivotally connecting two adjacent linking rods;

wherein one end of each linking rod pivotally connects with one of said first pivoting holes of fixed seat assemblies and the other end of said linking rod pivotally connects with one of said second pivoting holes of movable seat assemblies so as to make the escape ladder assembly can be extended down and become a ladder-like structure under emergency conditions.

2. According to the emergency escape device as claimed in claim 1, wherein each of said fixed seat assemblies further has a first top guiding portion, and a first bottom guiding portion, and each of said movable seat further having a second top guiding portion, and a second bottom guiding portion.

3. According to the emergency escape device as claimed in claim 1, wherein each of said fixed seat assemblies further has a screw hole for securing one of said seat assemblies on a horizontal rod.

4. According to the emergency escape device as claimed in claim 1, wherein said linking rods are twisted rods.

5. According to the emergency escape device as claimed in claim 1, wherein each of the movable seat assemblies has a single pivoting hole for pivotally connecting two linking rods.

6. According to the emergency escape device as claimed in claim 1, wherein the upper connecting structure and lower connecting structure have L-shaped connecting plates for fixing on the edges of said windows; connecting plates extending from said L-shapes plates; and holes on the ends of said L-shaped plates correspondingly.

7. According to the emergency escape device as claimed in claim 1, wherein said pair of the sliding groove assemblies further include two pins;

two stopping parts being disposed at the bottom end of said pair of sliding groove assemblies;

two pin seats being located at the bottom end and having two pin holes for inserting said pins; said pins seat further have corresponding through holes; and a rotatable controlling rod having a handle and three supporting parts extending from said controlling rod; said controlling rod being pivoted on the pin seats.

wherein the two pins are inserted into the holes and through the holes.

* * * * *